US005400931A

United States Patent [19]

Holta et al.

[11] Patent Number: 5,400,931

[45] Date of Patent: Mar. 28, 1995

[54] METERING UNIT FOR LIQUID MAGNESIUM

[75] Inventors: Olay Holta, Skien; Oystein Solli, Langangen; Vidar Sjoberg, Skien, all of Norway

[73] Assignee: Norsk Hydro a.s, Oslo, Norway

[21] Appl. No.: 95,213

[22] Filed: Jul. 23, 1993

[30] Foreign Application Priority Data

Oct. 23, 1992 [NO] Norway ..... 924107

[51] Int. Cl.[6] ..... B22D 39/06

[52] U.S. Cl. ..... 222/595; 266/239

[58] Field of Search ..... 266/216, 236, 239; 75/600; 222/591, 595

[56] References Cited

U.S. PATENT DOCUMENTS

| | | | |
|---|---|---|---|
| 2,713,705 | 7/1955 | Lapin | 222/595 |
| 3,448,898 | 6/1969 | Bennett | 222/595 |
| 3,800,986 | 4/1974 | Stamp | 266/239 |

FOREIGN PATENT DOCUMENTS

| | | | |
|---|---|---|---|
| 1359069 | 12/1987 | U.S.S.R. | 222/595 |

*Primary Examiner*—Scott Kastler

*Attorney, Agent, or Firm*—Wenderoth, Lind & Ponack

[57] ABSTRACT

A metering device for metal comprises a pump house (1) submerged in liquid metal in a container (6) with a supply device (4) for gas, an inlet (8,9) for the supply of liquid metal from the container (6) and an outlet pipe (5) designed as a siphon. The outlet end of this pipe is located at the same level as the level of the metal inside the crucible and the inlet end is fitted with a valve (13). It is preferable to use an outlet pipe designed with one part above the level of the metal in the crucible and one part below the level of the metal in the crucible. The pump house metal intake can be in the form of a valve or a riser pipe. It is preferable to use a valve in the form of a loose ball.

11 Claims, 3 Drawing Sheets

METERING UNIT FOR LIQUID MAGNESIUM

BACKGROUND OF THE INVENTION

The present invention concerns a metering device for metal, especially magnesium.

Various metering devices are available for feeding metal to automatic casting machines. They can be based on centrifugal forces, mechanical, electromechanical, gravimetric forces or gas pressure. Of these, pumps based on gas pressure and gravimetric forces (siphon) are used most commonly in magnesium foundries today. Rapid cycle times and the need for exact metering of the quantity of metal set high requirements for the metering system.

Standard centrifugal pumps and piston pumps have parts which are moved in the liquid metal. This gives rise to movement of the metal melt with the consequent formation of oxides. The pump inlet is usually located close to the base of the crucible with a danger of pumping contaminated metal. The pump parts which move in the liquid metal can suffer accelerated wear, which leads to imprecise measurements and high maintenance costs.

A siphon system is probably the metering system which is used most commonly for magnesium today. The inlet end, which is located in the liquid metal, is fitted with a valve which is opened and closed by a pneumatic cylinder. When the siphon is to be used the pipe is evacuated, filled with metal and the valve is closed. In the start position the discharge end must be lower than the level of metal in the furnace. For safety reasons the discharge end of the pipe is raised between each metering so that the level of metal in the discharge end equals or slightly exceeds the level of the metal in the furnace. This causes movement in the melt so that the surface film caused by the use of protective gas must be replaced. With this metering arrangement there have also been problems with leaky valves which produce imprecise weights for small shot quantities. Nor is it possible to alter the metering speed as the speed is dependent on the angle of incline of the pipe.

SUMMARY OF THE INVENTION

The object of the present invention is thus to produce a metering device with adjustable metal speed which supplies metal of good quality. A further object is to develop a system with rapid response and good precision which is suitable for the supply of metal to automatic casting machines.

These and other objects of the present invention are achieved with the device described below, the device being described in more detail.

The present invention comprises a metering device for metal comprising of a pump house submerged in liquid metal in a container with a feed device for gas, an inlet for feeding liquid metal from the container and an outlet pipe designed as a siphon. The outlet end of this pipe is located at the same level as the metal inside the crucible and the inlet end is fitted with a valve. It is preferable to use an outlet pipe designed in such a way that one part is above the level of the metal in the crucible and one part is below the level of the metal in the crucible. The pump house metal intake can be in the form of a valve or a riser pipe. It is preferable to use a valve in the form of a loose ball in both the outlet pipe and the valve case. Preferably the ball valve is made of molybdenium.

BRIEF DESCRIPTION OF THE DRAWINGS

The present invention will be described in more detail with reference to the enclosed drawings, FIGS. 1–3, in which.

DETAILED DESCRIPTION OF THE PREFERRED EMBODIMENTS

Figure 1:
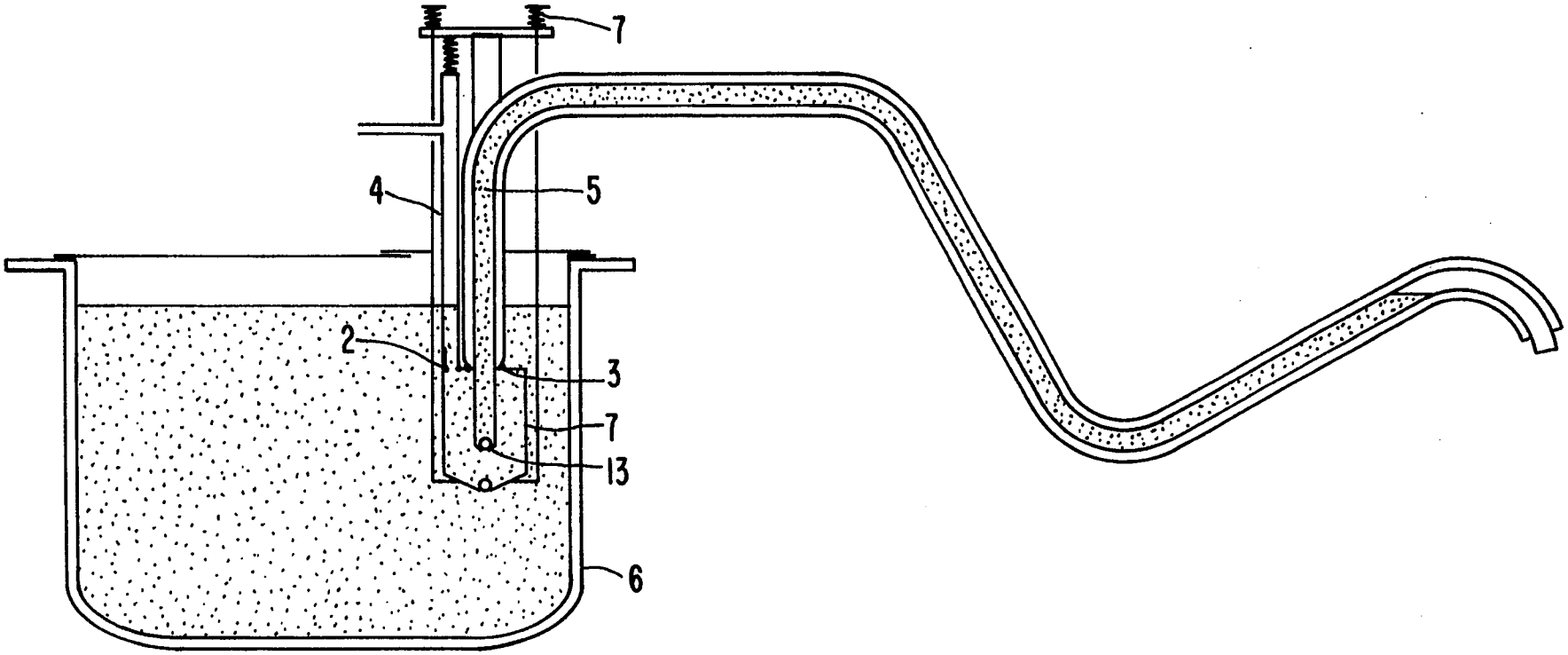
FIG. 1 shows a metering device mounted in a crucible with liquid metal.

As shown in FIG. 1 a metering device comprises a cylindrical pump house 1 with two openings 2,3 in the top for an inlet pipe 4 for gas under pressure and an outlet pipe 5 for the metal. The pump house is shown in more detail in FIG. 2. The metering device is located in a smelting crucible or furnace 6 as shown in FIG. 1. When the unit is mounted, steel springs 7 are used to ensure a sealed connection between the pump house and the pipes. When the gas under pressure is fed into the pump, the metal will be lifted out via the pipe. After a while the pressure is released and the pump house is filled with metal. The metal intake is located in the base of the pump house.

Figure 2A:
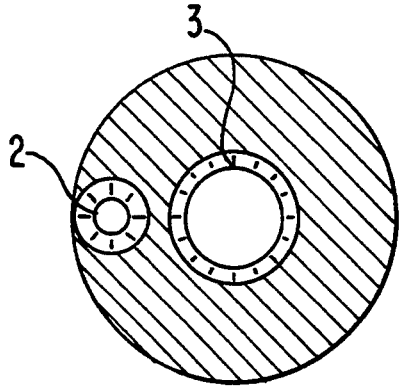
FIGS 2A, 2B and 2C show in 2A a top cover of a pump house, in 2B the pump house with a riser pipe and in 2C the pump house with a ball valve.
Figure 2B:
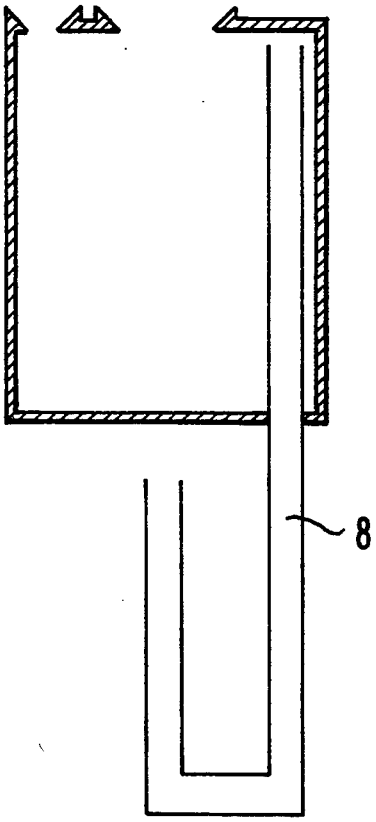

The pump house can be used both with and without the bottom valve. Two different designs are shown in FIGS. 2. FIG. 2B shows a metal intake in the form of a riser pipe 8. This is of advantage for its simplicity, but it restricts the pressure which can be used. The maximum pressure is achieved when the riser pipe is highest, i.e. the pipe should go as deeply down into the furnace as possible. To avoid sludge and impurities being sucked up from the base during filling, a bend has been made in the pipe as shown in the figure. Other designs can also be used.

Figure 2C:
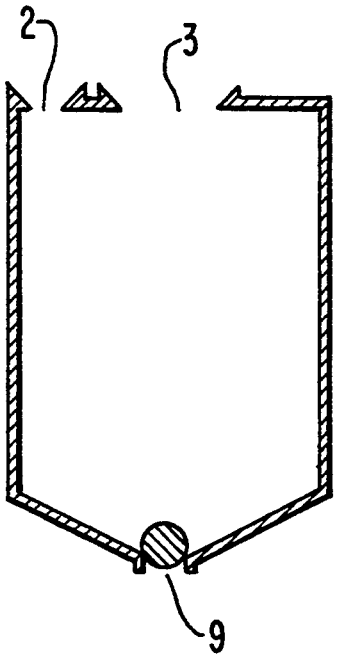

FIG. 2C shows the lower part of the pump house 1 with a conical design and a metal intake which is opened/closed by a bottom valve a 9. The bottom valve consists of a loose ball which opens when there is a level difference between the metal in the pump house and outside and closes by means of its own weight. This thus avoids the need for external connections to the valve. The valve is closed when the pump is under pressure during metering and opened when the pressure is released. The ball valve and its seat are preferably made of molybdenum. FIG. 2A shows the pump house from above with openings 2,3 for the introduction of the inlet and outlet pipes 4,5.

Figure 3:
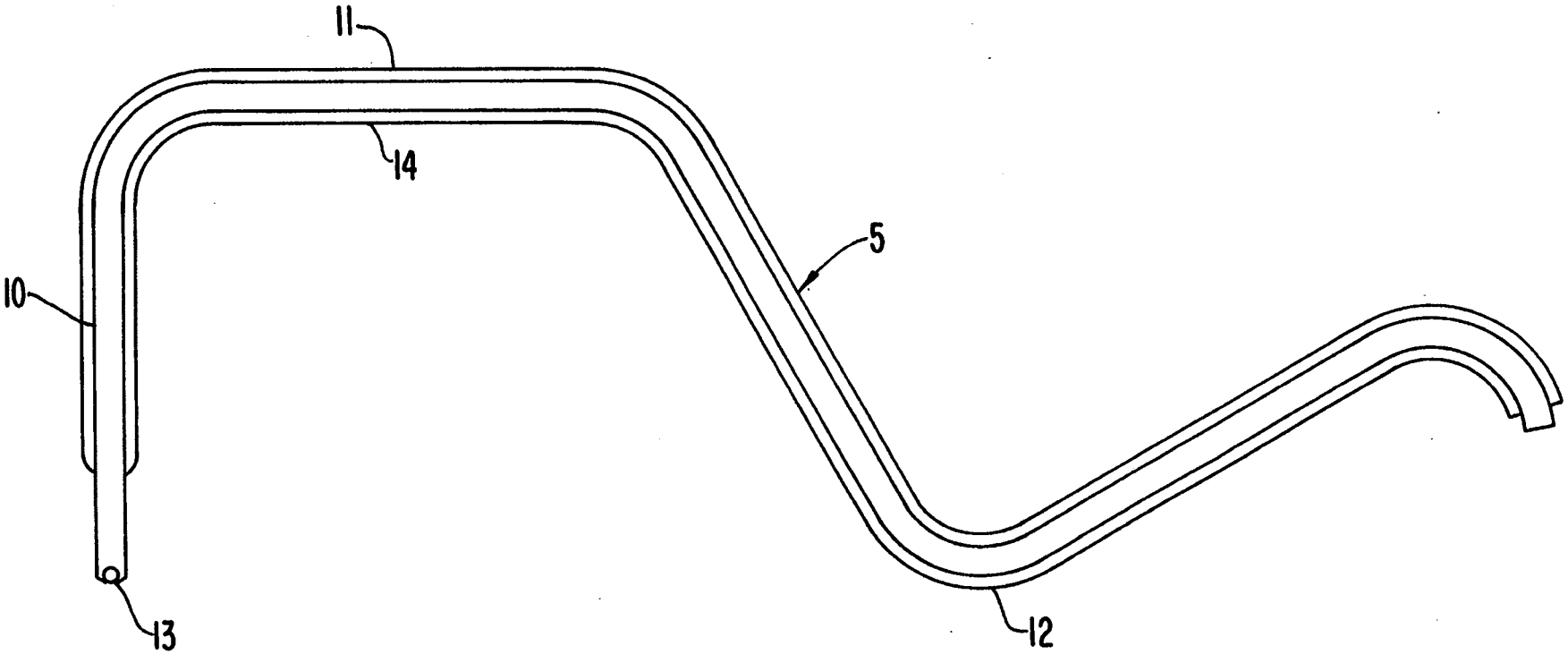
FIG. 3 shows a outlet pipe

The outlet pipe 5 is shown in more detail in FIG. 3. It is designed as a siphon. It has one part at a level above the level of the metal and one part below the level of the metal, while the outlet should be on the same level as the metal in the furnace. The pipe 5 is designed with a vertical part 10 which is located in the pump house. It is preferably arranged in line with the metal inlet in the pump case if the design with the ball valve is used. Another location is also possible. The vertical part of the pipe passes into a horizontal part 11 while the outlet end 12 of the siphon is V-shaped. Such a pipe will always be filled with metal. To prevent the metal being sucked back into the pump house when the pressure is released, the pipe is fitted with a non-return valve 13. This is preferably of the same type as that used in the pump house. That part of the outlet pipe which is not in contact with the metal is insulated (14) and is heated-by electric resistance elements which are wound around the inner steel pipe and fitted with thermocouples, which enables precise temperature control.

One of the advantages of making the metering device from so many parts is that it is very easy to dismount it and remove it from the melt. Parts can be cleaned or replaced and mounted back in the melt again.

The gas supply to the pump case is controlled by a pressure regulator and a timer which controls a magnetic on/off valve (not shown). The venting of gas from the pump case after metering takes place via the same magnetic valve. In order to collect the dust in the gas from the pump, it passes through a filter before it leaves. The timer will be used to control the weight of each metering. The metering weight and the metering time (metal speed) will thereby be controlled by a combination of setting the timer and the pressure regulator. In most cases where a valve-free pump case is used the pressure regulator will be fixed at the highest possible setting.

By using a siphon as the outlet pipe the pipe will always be filled with metal. This is of great advantage when casting magnesium, which oxidises easily. This is a rapid system, as the metal supply starts/stops immediately depending on the supply of gas. In fact, the metering time is limited more by the metal speed, which can produce turbulence if it is too high, than by the pressure which can be obtained. As there is no head for the metal, only a small pressure is required to set the metal flow in motion. The speed of the metal flow can easily be altered by changing the gas pressure. Nor does this system produce movement in the metal melt during use.

The outlet pipe produces a rapid response to signals from the control system as the metering starts and stops just tenths of a second after the signals have been given. This is important when the metering equipment is connected to an automatic casting machine, because the machine should complete the casting as rapidly as possible after the metering.

Tests have been carried out on metering magnesium with argon as the gas supply to test this pump. The aim was to be able to meter in quantities of 0.5 to 3 kg with a precision of ±10%. Tests were carried out first on a pump house with a valve in combination with a siphon. The conditions and results are shown in table 1.

TABLE 1

| Test | Time (sec) | Temp. (°C.) | Pressure ($mmH_2O$) | # Shots | Cycle time (sec) | Weight (g) | Dev. (± g) | Dev. (± %) |
|---|---|---|---|---|---|---|---|---|
| 1 | 1.0 | 680 | 4000 | 61 | 20 | 1107 | 56 | 5.1 |
| 2 | 2.0 | 660 | 5000 | 96 | 30 | 3136 | 64 | 2.0 |
| 3 | 0.5 | 700 | 5000 | 105 | 25 | 458 | 32 | 7.0 |
| 4 | 2.0 | 660 | 3000 | 100 | 18 | 2166 | 60 | 2.8 |
| 5 | 1.0 | 700 | 3000 | 103 | 16 | 910 | 36 | 4.0 |
| 6 | 1.0 | 660 | 3000 | 100 | 15 | 886 | 52 | 5.9 |
| 7 | 2.0 | 700 | 3000 | 101 | 13 | 2183 | 66 | 3.0 |
| 8 | 0.5 | 660 | 5000 | 100 | 13 | 449 | 42 | 9.4 |
| 9 | 2.0 | 700 | 5000 | 77 | 26 | 3211 | 74 | 2.3 |
| 10 | 1.0 | 660 | 5000 | 100 | 21 | 1350 | 50 | 3.7 |
| 11 | 1.0 | 700 | 5000 | 97 | 19 | 1449 | 46 | 3.2 |
| 12 | 0.5 | 660 | 3000 | 100 | — | 188 | 20 | 10.6 |
| 13 | 0.5 | 700 | 3000 | 101 | 12 | 222 | 26 | 11.7 |
| 14 | 1.0 | 680 | 4000 | 100 | — | 1178 | 48 | 4.1 |

Some tests were also carried out with a valve-free pump in combination with a siphon. The results are shown in table 2.

TABLE 2

| Test | Time (sec) | Temp. (°C.) | Pressure ($mmH_2O$) | # Shots | Cycle time (sec) | Weight (g) | Dev. (± g) | Dev. (± %) |
|---|---|---|---|---|---|---|---|---|
| 1 | 2.1 | 660 | 1200 | 100 | — | 495 | 42 | 8.5 |

Even though the metering device is described for particular use in connection with metering magnesium, such a device can also be used for metering other metals.

We claim:

1. A device for feeding metal, comprising:

a container containing liquid metal to a certain level; and a pump house submerged in the liquid metal in the container, said pump house having an interior, a gas supply device for supplying gas into said interior, an inlet for supplying liquid metal from said container to said interior, and an outlet pipe having an outlet end at the same level as the level of the liquid metal in said container and an inlet end having a valve communicating with said interior of said pump house.

2. The device of claim 1, wherein said outlet pipe comprises different pipe parts between said inlet end and said outlet end outside of said container, one of said pipe parts being located above the level of the liquid metal in said container and the other of said parts being located below the level of the liquid metal in said container.

3. The device of claim 1, wherein said valve of said inlet end of said outlet pipe is a ball valve.

4. The device of claim 1, wherein said inlet of said pump house is provided with a metal intake valve.

5. The device of claim 1, wherein said pump house has a lower part that is conically shaped and comprises said inlet of said pump house, and said metal intake valve comprises a ball valve.

6. The device of claim 1, wherein said inlet of said pump house comprises a riser pipe extending from said interior of said pump house into the liquid metal in said container.

7. The device of claim 6, wherein said riser pipe is U-shaped.

8. The device of claim 1, wherein said outlet pipe comprises a first, vertical pipe part extending from said inlet end, a second pipe part above the level of the liquid metal in said container extending from said vertical pipe part, and a third pipe part extending from said second pipe part, below the level of the liquid metal in said container, to said outlet end.

9. The device of claim 1, wherein said valve of said inlet end of said outlet pipe is a non-return valve operated by the fluid pressure of the liquid metal.

10. A device for feeding metal, comprising:

a container containing liquid metal to a certain level; and a pump house submerged in the liquid metal in the container, said pump house having an interior, a gas supply device for supplying gas into said interior, an inlet for supplying liquid metal from said container to said interior, and an outlet pipe having an outlet end at the same level as the level of the liquid metal in said container, an inlet end having a ball valve communicating with said interior of said pump house, and different pipe parts between said inlet end and said outlet end, one of said pipe parts being located above the level of the liquid metal in said container and another of said pipe parts being located below the level of the liquid metal in said container;

wherein said pump house has a lower part that is conically shaped and comprises said inlet of said pump house, and said metal intake valve comprises a ball valve.

11. A device for feeding metal, comprising:

a container for liquid metal; and a pump house in said container, said pump house having an interior, a gas supply device, a liquid metal inlet communicating said interior with said container, and an outlet pipe having an outlet end adapted to be at the level of liquid metal in said container in operation and an inlet end having a ball valve communicating with said interior of said pump house.

* * * * *